United States Patent [19]

Smith

[11] 4,341,336

[45] Jul. 27, 1982

[54] DIMPLER ATTACHMENT AND IMPROVED FASTENER DRIVING TOOL

[76] Inventor: Gareth J. Smith, 15533 Tupper St., Sepulveda, Calif. 91343

[21] Appl. No.: 148,687

[22] Filed: May 12, 1980

[51] Int. Cl.[3] ..... B25C 1/04; B25C 7/00

[52] U.S. Cl. ..... 227/66; 227/64; 227/130

[58] Field of Search ..... 227/10, 64, 66, 130

[56] References Cited

U.S. PATENT DOCUMENTS

| | | | |
|---|---|---|---|
| 2,723,532 | 11/1955 | Smith | 227/10 X |
| 2,918,675 | 12/1959 | Smith | 227/66 |
| 3,027,560 | 4/1962 | Nelson | 227/66 |
| 3,040,327 | 6/1962 | Michel | 227/66 |
| 3,774,293 | 11/1973 | Golsch | 227/66 X |

*Primary Examiner*—Paul A. Bell
*Attorney, Agent, or Firm*—John J. Posta, Jr.

[57] ABSTRACT

An improved dimpler attachment for use on gypsum wall board and the like for fastening on a fastener driving tool. The tool housing has a driving piston, pneumatic or other power means to reciprocate the piston and an elongated driver connected to the piston for reciprocation and extending out of the housing. A slide connects a dimpler head to the outside of the housing and bears a fastener magazine. The dimpler head has a central channel slidingly engaging the driver and a pocket adapted to functionally seat a stop plug connected to the driver. The head is connected to the housing by return springs. The front end of the head is curved so that it effects a dimpling action when urged forward on the slide by the forward movement of the plug while seated in the pocket during forward movement of the driver. The driver front end preferably is chamfered to facilitate stripping of fasteners from the magazine and preferably is curved to match the head so as to effect flush seating of a fastener in the hole of a dimple made in a substrate during operation of the tool. The dimpler attachment comprises the described head, slide, return springs and driver which are readily attachable to conventional fastener driving tools.

10 Claims, 7 Drawing Figures

DIMPLER ATTACHMENT AND IMPROVED FASTENER DRIVING TOOL

BACKGROUND OF THE INVENTION

1. Field of the Invention

The present invention generally relates to fastening means and more particularly to the improved fastener driving tool and to an improved dimpler attachment for the same.

2. Prior Art

Various types of fastener driving tools have been devised. Most do not incorporate means for dimpling the area around the fastener. See, for example, U.S. Pat. Nos. 3,106,136; 2,995, 113; 2,585, 939; 2,887,686; 4,091,981, 3,001,169; 2,679,044; 4,040,554, and 4,068790. However, in order to attach gypsum wallboard and the like to wooden structural members, building codes, fire codes and gypsum board manufacturers, among others, generally require the completed fastening process to have the following properties:

1. The head of the fastener must be forced below the surface of the surrounding wallboard in order to allow wallboard compounds to be placed over and completely conceal the fastener;
2. The head of the fastener should be seated in the bottom center of a dimple adapted to contain the wallboard compound;
3. The head of the fastener must not break the paper surface of the wallboard; and
4. The wallboard must be drawn as tightly against the wooden structural members as possible.

The lack of means to effectively dimple to meet the above requirements has rendered many conventional fastener driving tools unsuitable for wallboard applications. It would be desirable to be able to easily, inexpensively add dimpling means to such devices.

Certain fastener driving tools, however, do include dimpling members. See, for example, U.S. Pat. Nos. 3,774,293; 3,040,327; 3,027,560; and 2,918,675. Most such devices still have one or more deficiencies. Thus, in some cases, the tools are heavy, cumbersome, complicated and expensive, depending on, in some instances, separate power activators for the fastener driver and dimpler.

U.S. Pat. No. 3,774,293, discloses a device which in operation tends to have the driver bounce the tool and dimpler away from the substrate so that light and variable dimpling may occur. There is no positive retention of the dimpling head against the substrate during dimpling and fastener seating. In some instances, the driving and dimpling actions are so uncoordinated that the fastener is only driven to the level of the substrate and the dimple is then made around it, so that the fastener projects up above the base of the dimple.

U.S. Pat. No. 3,040,327 discloses a fastener driving and dimpling tool which does not have means to gradually and effectively slow the driver while transferring energy to the dimpler, so that slap and bounce of the tool can occur during its operation, with variable results.

U.S. Pat. No. 2,918,675 discloses fastener driving and dimpling tool with no energy cushioning means whatsoever, and consequently subject to bounce and erratic results.

U.S. Pat. No. 3,027,550 discloses a dimpler mechanism with complicated biasing means for keeping the dimpler out of an operative position until desired, but again, with no energy cushioning means and also subject to erratic results.

Accordingly, there is a need for an improved, simpler inexpensive and efficient fastener driving and dimpling tool which works smoothly and with proper coordination of the driver and dimpler to uniformly fully seat the fastener in the base of the dimple without damage to the wallboard covering. Preferably, the tool dimpler attachment should be capable of being separately mounted on and utilized with conventional fastener driving tools not having dimpler mechanisms. Such tool should be capable of being dry fired without damage. Moreover, the head of the fastener delivered by the tool and the dimpler should not rupture the wallboard covering (paper or the like) if during such penetration the structural member backing the wallboard is missed. Preferably the tool should be capable of accepting thin headed fasteners and of delivering fasteners and dimpling into tight places such as corner.

The weight of the dimpling head should be substantial enough to have sufficient inertia to draw the gypsum wall board and wood member together.

SUMMARY OF THE INVENTION

The foregoing needs are satisfied by the improved fastener driving tool of the present invention and by the improved dimpler attachment connected thereto and such attachment is easily connectable to a number of conventional fastener driving tools. The tool and dimpler attachments are substantially as set forth in the Abstract above and can be made small for tight corners and adaptable to various fasteners.

Thus, the tool includes an elongated driver, preferably with rounded tip and chamfered front, extending from the tool body and enclosed in an external dimpler head connected to the tool body by an external slide and return springs.

The front end of the head is curved and the head includes a central passageway and rear pocket connected thereto. A fastener magazine is connected to the slide and a passageway therethrough intersects the central passageway. A resilient stop plug on the rear end of the driver frictionally seats and expands in the pocket when the driver is urged forward by a piston in the tool housing, thus slowing the driver to prevent bounce and by momentarily locking driver and head together, and smoothly urging the head forward to effect the dimpling function while the head is firmly against the substrate, thus coordinating it with the fastener driving fuction so that the fastener is always uniformly seated in the base of the dimple. Other features of the invention are set forth in the following detailed description and accompanying drawings.

BRIEF DESCRIPTION OF THE DRAWINGS

FIGS. 1–6

Figure 6:
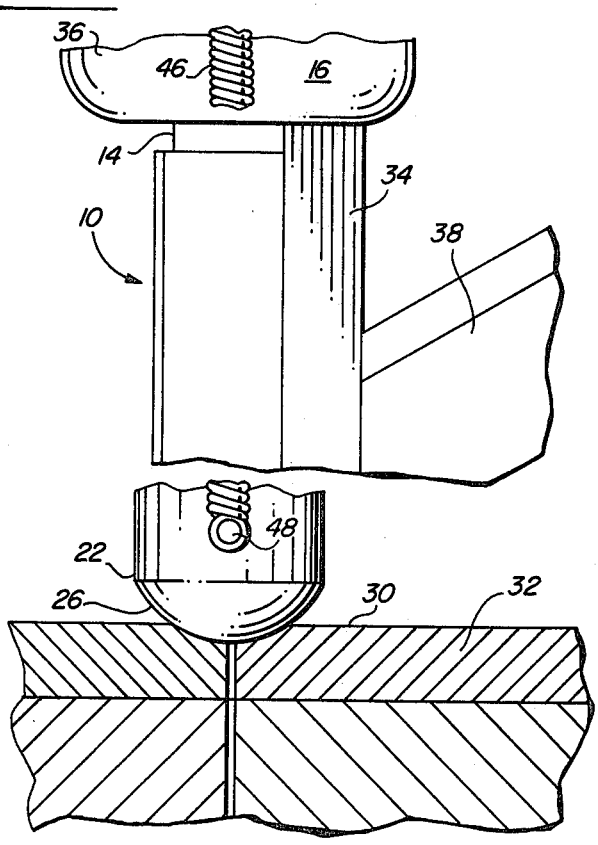
FIG. 6 is a schematic view of the dimpler attachment of FIG. 1 including a magazine shown in a vertical orientation connected to a pneumatic fastener driving tool, and a cut-away view of gypsum wall board, structural wood member and a fastener in preferred placement just after completion of dimpling.
Figure 7:
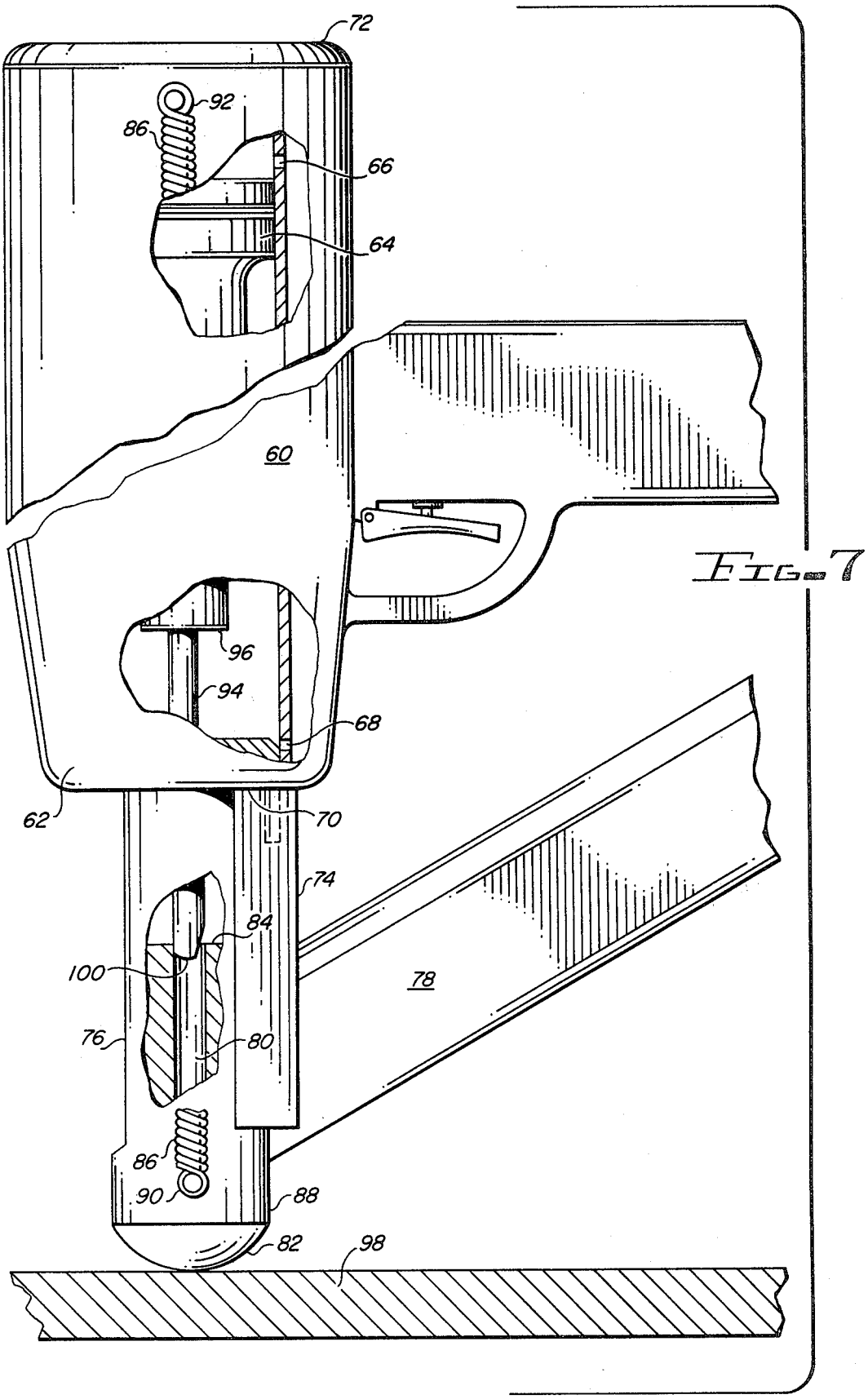
FIG. 7 is a schematic side elevation, partly broken away, of a preferred embodiment of the improved fastener driving tool of the present invention, incorporating a modified view of the improved dimpler attachment of the invention.

Now referring more particularly to FIGS. 1–6, an improved dimpler attachment is shown which is mountable, as shown in FIG. 6, on a conventional fastener driving tool. Thus, dimpler attachment 10 is shown which comprises an elongated driver 12 securable at its rear end to the driving piston 14 of a conventional fastener driving tool, such as a pneumatic staple gun 16 (FIG. 6), and 60 (FIG. 7).

Attachment 10 also includes a resilient washer plug or cushion 18 of nylon, teflon, or the like attached to and enclosing the rear end of driver 12. Cushion 18 is dimensional to be slideably frictionally received in the rear pocket 20 of elongated dimpler head 22, which pocket communicates with a central passageway 24 extending to the front end or nose 26 of head 22. Passageway 24 is adapted to slideably receive driver 12. Cushion 18, pocket 20 and passageway 24 are dimensioned such that when piston 14 drives driver 12 into head 22 so that cushion 18 seats in pocket 20, curved tip 28 of driver 12 will extend below the top surface 30 of a substrate 32 of wallboard or the like only for a predetermined distance, for example $\frac{1}{8}''$–$\frac{3}{8}''$.

Figure 1:
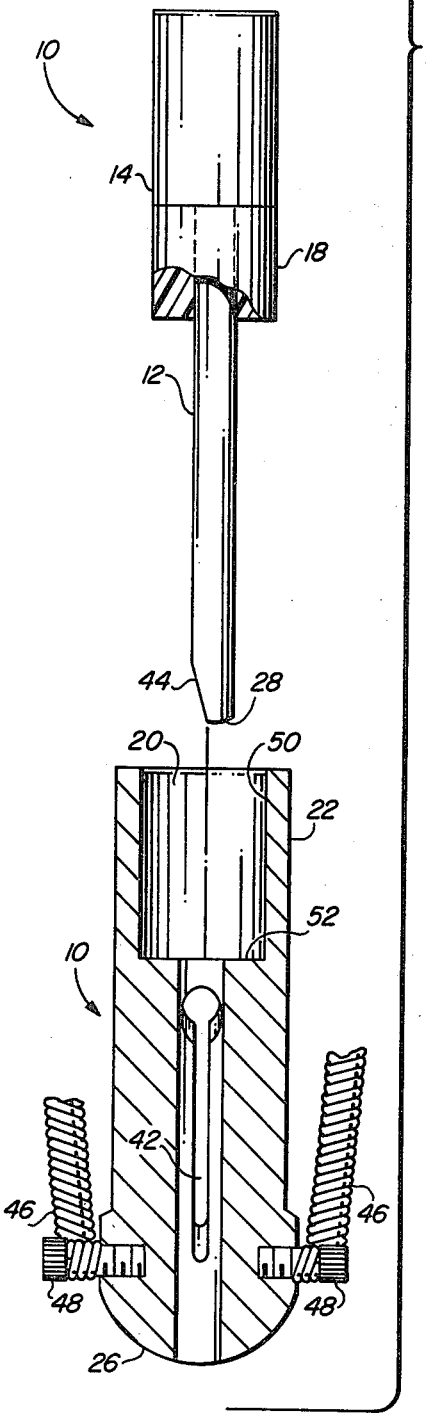
FIG. 1 is a schematic top plan view, partly in section of the driver and dimpler head portions of a preferred embodiment of the improved dimpler attachment of the present invention.
Figure 2:
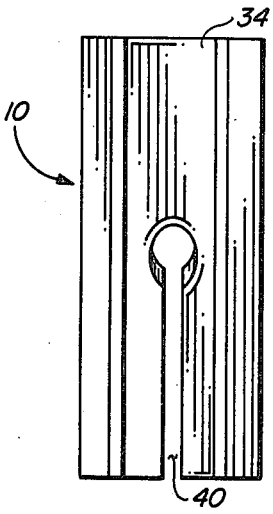
FIG. 2 is a schematic bottom plan view of a slide utilized with the head of FIG. 1.
Figure 3:
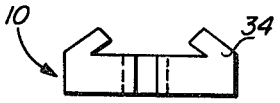
FIG. 3 is a schematic end view of the slide of FIG. 2.
Figure 4:
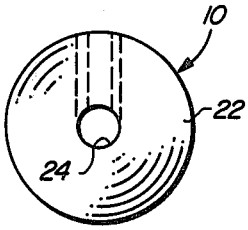
FIG. 4 is a schematic front elevation of the head of FIG. 1.
Figure 5:
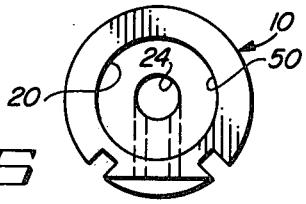
FIG. 5 is a schematic rear end view of the head of FIG. 1.

Attachment 10 also includes a slide 34 slideably received on head 22 and securable to the housing 36 (FIG. 6) of gun 16. A fastener containing magazine 30 (FIG. 6) is connected to slide 34 and matching slots 40 and 42 are provided in slide 34 and head 22, as shown in FIGS. 1 and 2, through which fasteners (not shown) from magazine 38 can enter passageway 24 (under spring urging or the like). The front portion 44 of driver 12 may be chamferred to aid in smoothly stripping fasteners, such as staples, (not shown) from a mass joined together and fed from magazine 38 during operation of gun 16.

Attachment 10 also includes return springs 46 secured on opposite sides of head 22, as by machine screws 48, (FIG. 1) and to housing 36 of gun 16 (FIG. 6). Thus, when piston 14 is actuated to urge driver 12 forward through passageway 24, portion 44 strips off a fastener entering passageway 24 from slot 42 and pushes it into surface 30 of substrate 32, this event being timed to substantially coincide with dimpling of substrate 32 by nose 26 so that the fastener seats flush in the base of the dimple.

When cushion 18 on driver 12 moves into pocket 20, it preferably slidably engages the sidewall 50 of pocket 20 and then seats against the front end 52 while expanding to effectively lock itself to sidewall 50, of that pocket, slowing driver 12 transferring energy smoothly to head 22 and urging it forward to perform the described dimpling action against the restraint of return springs 46. Positive simultaneous urging of both driver 12 and dimpling head 12 forward in a controlled way eliminates bouncing of the driver 12 and/or head 22 and uncoordinated fastener drifting and dimpling. Head 12 is kept against the substrate for effective dimpling. The result is uniformly perfect fastening and dimpling in an essentially recoilless mode for improved results. Tip 28 can be curved to substantially match the curvature of nose 26 so that even the head of the fastener can be bent to lie flat in the dimple so formed, all without damage to the covering on surface 26 and without causing the fastener to be pushed all the way into substrate 32. Moreover, mounting of attachment 10 on conventional fastener driving tools can be easily and quickly accomplished.

FIG. 7

A modified form of the improved dimpler attachment of the invention is schematically depicted in FIG. 7 incorporated into and forming part of a preferred embodiment of the improved fastener driving tool of the invention. Thus, in FIG. 7 is shown a pneumatic fastener driving tool 60 which includes a hollow housing 62 containing a driving piston 64 and air inlets 66 and 68 disposed, respectively, adjacent to the front end 70 and rear end 72 of housing 62, and a slide 74 rigidly attached to end 70 and slideably attached to dimpler head 76 extending forward of housing 62.

A magazine 78 bearing fasteners (not shown) is rigily connected to slide 74 and to housing 62 (not shown). Head 76 and slide 74 include openings (not shown) which permit the transfer of fasteners to a longitudinal central passageway 80 in head 76 which extends from curved nose 82 to a rear expanded pocket 84 in head 76. Head 76 can slide forward of end 70 on slide 74 but is limited in movement by a pair of return springs 86 and to housing 62 by screws 92 and 90.

The front end of piston 64 is fitted with a forwardly extending elongated driver 94 which bears a resilient washer or cushion 96 adjacent its rear end. Cushion 96 is of greater diameter than driver 94 and fits within pocket 84. Thus, tool 60 operates similarly to tool 16.

When fluid (air, etc) passes into housing 62 to force piston 64 forward, driver 94 passes through passageway 80, picks up a fastener from magazine 78 (via slide 74) and drives it into substrate 98. Substantially simultaneously head 76 is urged forward against limit springs 86 by cushion 96 in pocket 84, so that, without shock or bounce, head 76 is held against substrate 98 and is driven into substrate 98 to dimple it to the same depth as the fastener is driven by driver 94. Tip 100 of driver 94 may be curved to cause the head (not shown) of fastener to follow the curve of the dimple.

Once the driving and dimpling are completed, fluid (air) applied to the front face of piston 64 through inlet 68 drives it rearwardly, retracting driver 94, while springs 86 cause head 76 to slide rearwardly to seat against end 70. Tool 60 is then ready for the next driving and dimpling operation. The sequence is smooth, rapid, and essentially recoilless for perfectly timed operation. Tool 60 can be dry fired without harm, since the forward movements of driver 94 and head 76 are cushioned and limited. Firing of fasteners through wallboard will not occur. Other advantages are set forth in the foregoing.

Various changes, modifications, alterations and additions can be made in the improved fastener driving and dimpling tool of the invention in the improved dimpling attachment of the invention and in the components and parameters for the same. All such changes, modifications, alterations and additions as are within the scope of the appended claims form part of the present invention.

What is claimed is:

1. An improved dimpler attachment for a fastener driving tool, said attachment comprising, in combination:

(a) a dimpler head defining a curved dimple-forming front end, a central passageway, extending longitudinally rearwardly from said front end and an expanded pocket communicating with the rear end of said passageway;

(b) an elongated driver slidable within said passageway and extendable from the said front end to drive a fastener into a substrate, the rear end of said driver bearing means connectable to the driving piston of a fastener driving tool;

(c) resilient stop means connected to said driver and diametrically dimensioned to fit into said pocket but larger than said passageway to limit forward movement of said driver and transmit dimpling force to said head;

(d) said resilient stop means comprising releasable locking means to lock the driver with said dimpler head;

(e) slide means slideably connected to said head and connectable to a fastener driving tool to permit reciprocation of said head external of said tool;

(f) fastener magazine means connected to said head and connectable to a fastener driving tool to facilitate said reciprocation.

2. The improved dimpler attachment of claim 1 wherein the front tip of said driver is curved to generally conform to the curvature of said front end of said head to effect flush placement of a fastener within the base of a dimple during operation of said attachment on a fastener driving tool.

3. The improved dimpler attachment of claim 1 wherein the front portion of said driver is chamfered to facilitate ejecting of fasteners from said magazine into said passageway.

4. The improved dimpler attachment of claim 1 where said magazine is attachable to a fastener driving tool.

5. An improved dimpler attachment for a fastener driving tool, said attachment comprising, in combination:

(a) a dimpler head defining a curved dimple-forming front end, a central passageway, extending longitudinally rearwardly from said front end and an expanded pocket communicating with the rear end of said passageway;

(b) an elongated driver slidable within said passageway and extendable from the said front end to drive a fastener into a substrate, the rear end of said driver bearing means connectable to the driving piston of a fastener driving tool;

(c) resilient stop means connected to said driver and diametrically dimensioned to fit into said pocket but larger than said passageway to limit forward movement of said driver and transmit dimpling force to said head;

(d) slide means slideably connected to said head and connectable to a fastener driving tool to permit reciprocation of said head external of said tool;

(e) fastener magazine means connected to said head and connectable to a fastener driving tool to facilitate said receiprocation (f) wherein said stop means comprises a plug concentrically disposed around the rear end of said driver and wherein said plug is dimensioned to slidably engage the sidewall defining said pocket to facilitate slowing of movement of said driver in said passageway, and to expand to lock itself with said sidewall.

6. An improved fastener driving tool, said tool comprising, in combination;

(a) a tool housing having a driving piston disposed therein;

(b) power means in said housing for drivingly reciprocating said piston;

(c) an elongated driver connected to said piston and extending outwardly from said housing for reciprocation with said piston;

(d) a dimpler head disposed external of said housing, said head defining a curved dimple-forming front end, a central passageway extending longitudinally rearwardly from said front end and an expanded pocket communicating with the rear end of said passageway, said driver being slidably disposed in said passageway and extendable from said front end to drive a fastener into a substrate;

(e) resilient stop means connected to said driver and diametrically dimensioned to fit into said pocket but larger than said passageway so as to limit forward movement of said driver and transmit dimpling force to said head;

(f) said resilient stop means comprising locking means to lock the driver with said dimpler head;

(g) slide means slidably connected to said head and to said housing to permit reciprocating of said head;

(h) fastener magazine means connected to said slide means for delivery of fasteners into said passageway; and (i) spring return means connected to said head and to said body to facilitate said reciprocation.

7. The improved fastener driving tool of claim 6 wherein the front tip of said driver is curved to generally conform to the curvature of said front end of said heads to effect flush placement of a fastener within the base of a dimple formed during reciprocation of said head.

8. The improved fastener driving tool of claim 6 wherein the front end of said driver is chamfered to facilitate ejecting of fasteners from said magazine into said passageway.

9. The improved fastener driving tool of claim 6 wherein said magazine is attached to said housing and wherein said power means comprises pneumatic means.

10. An improved fastener driving tool, said tool comprising, in combination:

(a) a tool housing having a driving piston disposed therein;

(b) power means in said housing for drivingly reciprocating said piston;

(c) an elongated driver connected to said piston and extending outwardly from said housing for reciprocating with said piston;

(d) a dimpler head disposed external of said housing, said head defining a curved dimple-forming front end, a central passageway extending longitudinally rearwardly from said front end and an expanded pocket communicating with the rear end of said passageway, said driver being slidably disposed in said passageway and extendable from said front end to drive a fastener into a substrate;

(e) resilient stop means connected to said driver and diametrically dimensioned to fit into said pocket but larger than said passageway so as to limit forward movement of said driver and transmit dimpling force to said head;

(f) slide means slidably connected to said head and to said housing to permit reciprocating of said head;

(g) fastener magazine means connected to said slide means for delivery of fasteners into said passageway;

(h) spring return means connected to said head and to said body to facilitate said reciprocation; and (i) wherein said stop means comprises a plug disposed concentrically around the rear end of said driver and dimensioned to slidably engage the sidewall defining said pocket to facilitate slowing of movement of said driver in said passageway.

* * * * *